United States Patent [19]

Zayat

[11] Patent Number: 4,887,498

[45] Date of Patent: Dec. 19, 1989

[54] CLAMPING TOOL

[76] Inventor: Charles Zayat, 100 New Hampshire St., Cranston, R.I. 02920

[21] Appl. No.: 264,852

[22] Filed: Oct. 31, 1988

[51] Int. Cl.[4] ..... B25B 13/12

[52] U.S. Cl. ..... 81/185; 81/DIG. 11

[58] Field of Search ..... 81/185, DIG. 11

[56] References Cited

U.S. PATENT DOCUMENTS

| | | | |
|---|---|---|---|
| 1,997,948 | 4/1935 | Pearson | 81/185 |
| 3,251,251 | 5/1966 | Popper et al. | 81/185 |
| 3,349,655 | 10/1967 | Locke | 81/185 |
| 3,858,468 | 1/1975 | Pasbrig | 81/185 |
| 4,416,173 | 11/1983 | Rebish | 81/185 |

FOREIGN PATENT DOCUMENTS

| | | | |
|---|---|---|---|
| 315926 | 11/1919 | Fed. Rep. of Germany | 81/185 |

*Primary Examiner*—D. S. Meislin

*Attorney, Agent, or Firm*—Robert J. Doherty

[57] ABSTRACT

A tool for form engaging and turning components such as nuts, bolts, and screws. In its basic form, it includes a chamber which in turn supports a bundle of pins each of which is adapted to slide further upwardly into the chamber when the lower pin end contacts the component at the lower end of the housing.

18 Claims, 4 Drawing Sheets

CLAMPING TOOL

BACKGROUND AND OBJECTS OF THE INVENTION

This invention relates to a clamping tool for the form engagement and twisting of various components such as headed nuts and bolts and slotted screws. The tool is designed such that one size tool accommodates a great variety of differently sized and shaped components thus eliminating the need for many standardized or specialized tools to accomplish the same result. Thus to utilize a specific example, the tool can be formed in the shape of a socket wrench such that only a single tool is needed to accommodate a wide variety of nuts instead of having a different socket tool for each size nut.

Earlier attempts to do such were either generally complicated or expensive or did not entirely satisfactorily provide the intended result. One patent showing a device of this general type is that to Pearson, U.S. Pat. No. 1,997,948, issued Apr. 16, 1935 which shows a plurality of hexagon-shaped tubes nested in concentric fashion such that when a lock is removed, one or more of the innermost tubes may slide downwardly to engage a nut. Another patent is that to Pasbrig, U.S. Pat. No. 3,858,468, issued Jan. 7, 1975 which describes a device which includes a number of bars or slidable rods housed within a chamber which is further provided with a elastic cushion which enables certain rods to recede when contacted by variously shaped and sized nuts. Another device of this general type which the present applicant is aware is that described in U.S. Pat. No. 4,416,173 to Rebish issued Nov. 22, 1983.

Another object of the present invention is to provide a device of the general type above described which assures positive gripping of a wide range of both differently sized and shaped components in a positive and trouble free manner yet which can be manufactured at a reasonable cost.

A still further object of the present invention is to provide a device of the general type above described which can also be utilized to positively form engage components which include a drive recess portion hitherto unachievable in prior art devices.

These and other objects of the present invention are accomplished by a tool for turning components of varying sizes and shapes by the form engagement thereof comprising a housing forming a chamber open at the lower end thereof, a bundle of individual pins having upper and lower ends longitudinally oriented in said chamber in a first normal position with their lower end surfaces adapted to contact the varying size and shape components, said housing having suspension means at the upper end thereof engaging the upper pin ends for suspending said pins in individual slidable relationship to each other where contact of the pin lower end surfaces with the component will force the contacted pins further upwardly into said chamber to a second position and means for returning said pins to their first normal position once contact with the component is removed.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
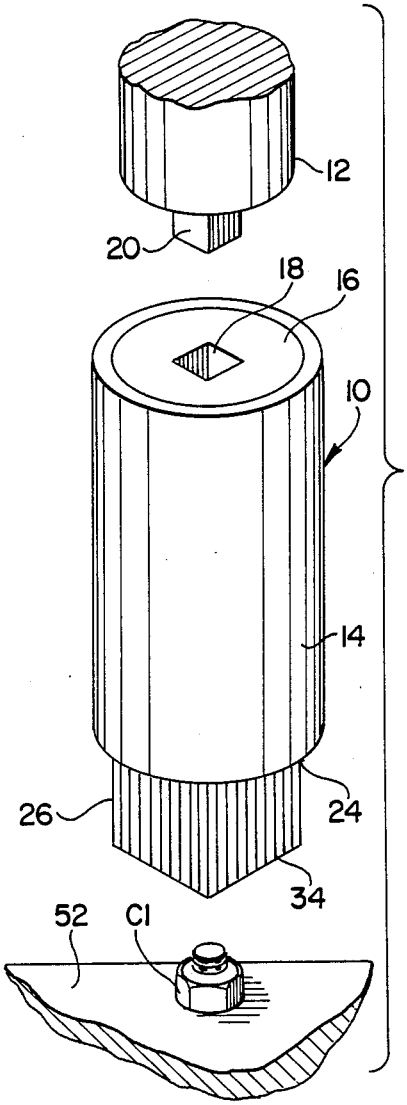
FIG. 1 is an overall partial perspective view of a socket wrench incorporating the features of the present invention.

Turning now to the drawings and particularly FIG. 1 thereof, the invention is shown in the embodiment of a socket 10 of a socket wrench, the drive component 12 thereof being partially illustrated. The socket includes a conventional housing 14 depicted as tubular but may be of any shape and having in its uppermost end 16 a drive recess 18 to accommodate a drive lug 20 of the drive member 12. Although illustrated as a socket, the device 10 of the present invention may take many other forms if such provides a housing 14 in turn forming an internal chamber 22 which is open at its bottom end 24 and adapted to house a plurality of side by side positioned individual pins 26 therein.

The pins 26 are positioned within the chamber 22 such that their upper ends 28 are suspended by a suspension means 30 at the chamber upper end 25 such that the individual pins are free for upward retraction into the upper part of the chamber when the lower end surfaces 34 thereof are contacted by a driveable component such as a nut, screw head, and the like in the intended manner.

Figure 3:
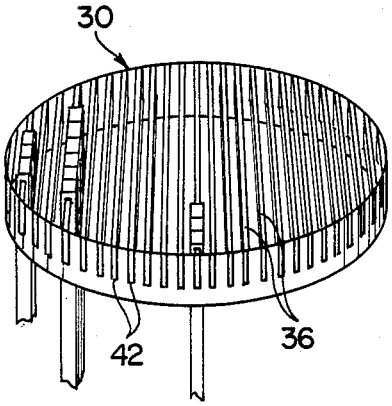
FIG. 3 is a partial perspective view showing one suspension system for the bundle of pins.

As best illustrated in FIG. 3 and the subsequent drawings, the suspension means 30 preferably comprises a series of parallel rails 36 extending horizontally across the upper end of the chamber 22 and laterally spaced from each other. Such rails 36 may be thin strips of suitably engineered material such as steel and the like and in most forms of the invention are rigid, that is, they diametrically cross the lower end of the chamber 22 and are not free to move up or down although some side to side movement could take place with such thin members. Alternatively, the rails 36 could be of other configurations, the important feature being that they form, in essence, a platform from which the individual pins are suspended for the desired retractable longitudinal movement hereto before described.

Each of the pins at its upper end 28 is provided with an elongated closed slot 40. In assembly of the device, the diametrically aligned pins 26 are positioned such that the slots 40 thereof are aligned and an appropriate rail 36, in essence, threads through the thus aligned slots 40 to engage and suspend each of the pins 26 in the intended manner. It should thus be apparent that when so suspended, that when the bottom ends 34 of a group of pins 26 is contacted by a component member, those contact pins are free to slide upwardly into the chamber 22 a length determined by the component height and, of course, the longitudinal extent of the slots 40. Any suitable mechanism may be provided to attach the rails 36 to opposed edges of the chamber 22 in the housing walls 14 which may be provided with seats 42 for such purpose. Any suitable means may also be utilized to assure the rails 36 do not move relative to the housing including their permanent affixation to the housing walls as by welding and the like.

Figure 2:
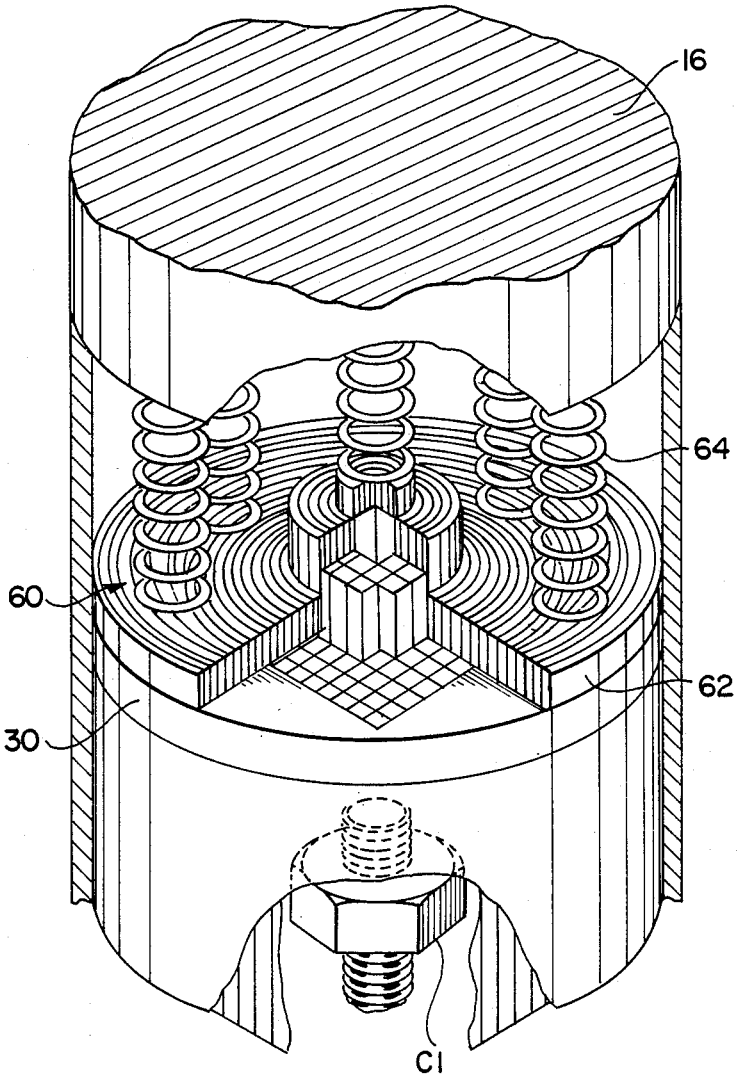
FIG. 2 is a partial perspective view on an enlarged scale of a portion of the device shown in FIG. 1 with parts broken away for clarity.
Figure 10:
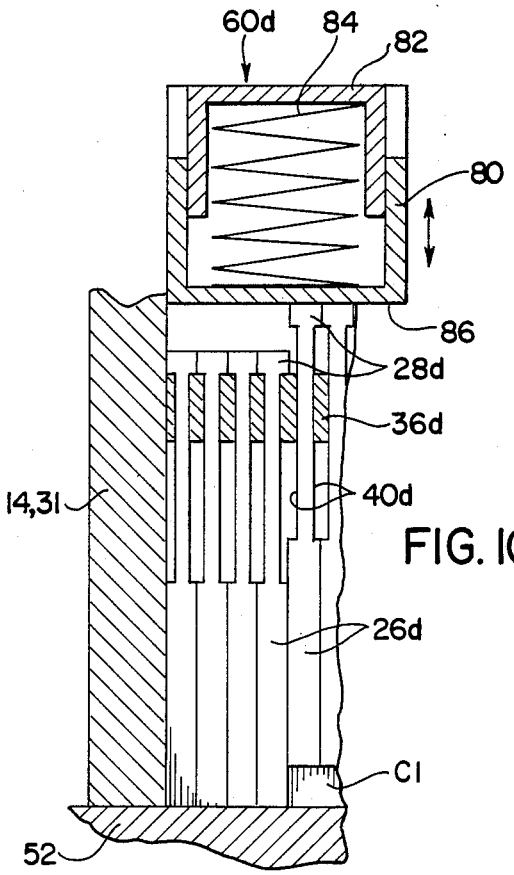
FIG. 10 is a partial side elevational view similar to FIGS. 8 and 9 but showing another pin and pin support system.

A preferred manner of attaching the suspension means 30 to the housing walls 14 is illustrated in FIG. 10. Therein the pins 26 are held within a casing 31 which may preferably be of square cross-sectional configuration, i.e., to conform to the pin array shown in FIG. 2, rather than that as illustrated in FIG. 3 although either configuration is suitable. Such casing 31 is fixedly attached to the socket walls 14, that is, the outer casing walls of the socket in most applications, with one or more set screws 33.

Figure 4:
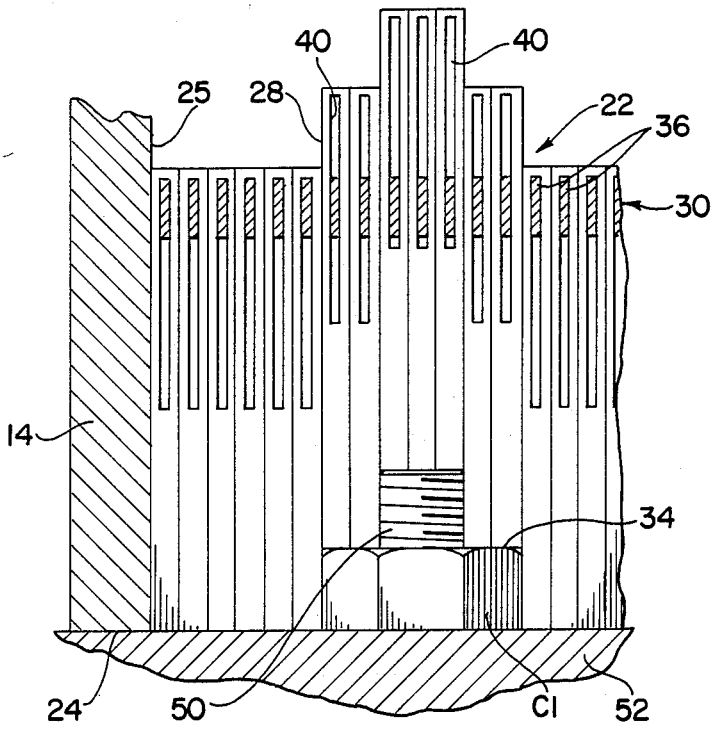
FIG. 4 is a side elevational view on an enlarged scale showing the manner in which pins may be vertically displaced to accommodate a hex nut.
Figure 5:
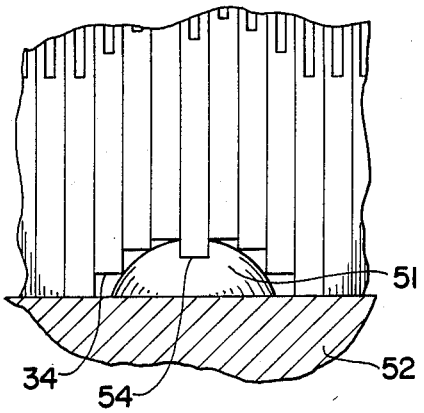
FIG. 5 shows the manner in which a pin or pins may be displaced to accommodate the recessed slotted head of a screw member.
Figure 6:
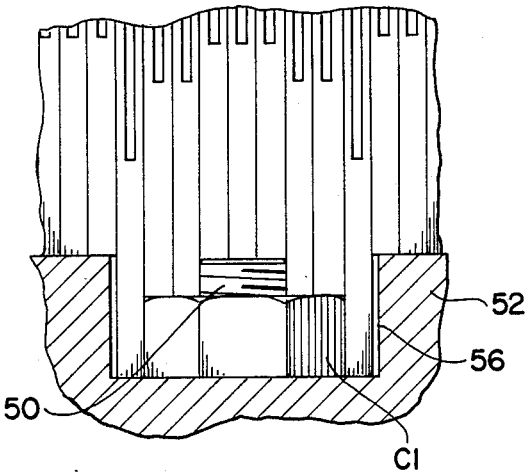
FIG. 6 is a view similar to FIGS. 4 and 5 but showing the manner in which pins may accommodate a recessed hex nut.

Turning now specifically to FIGS. 4 through 6 of the drawings, various size and shape components are shown being contacted by the pins 26 of the present invention in the intended manner. In FIG. 4, a nut component C1 of standard hexagonal shape is shown attached to a threaded bolt 50 and projecting from a surface 52. In operation, the device of the present invention is superposed above the nut C1 such that the lower edge of the chamber 24 rests on the member 52 or is proximal thereto and the lower ends 28 of the pins 26 contact both the upper surfaces of the nuts C1 and the bolt 50. With such contact, the pins 26 are free to rise up into the chamber 22 to accordingly accommodate the form of the nut component C1 such that engaging drive contact with inner edges of the pins 26 and the outer surfaces of the nut C1 is accomplished in the intended manner. Thereafter, the housing need only be rotated vis-a-vis the nut C1 such that it is either tightened or loosened in the intended manner. Such rotation may be accomplished by the drive component 12 or any other appropriate mechanism.

In FIG. 5, the surface 52 is provided with an outwardly projecting screw member 51 which includes a recessed drive component 54. In such case, an aligned group of pins 26 is adapted to extend downwardly into the recess 54 to form a drive connection therewith, and the laterally adjacent pins adapted to extend upwardly into the chamber 22 to accommodate the remaining shape of the screw head S1. Similarly in FIG. 6, the surface 52 is provided with a recess 56 which includes a driveable component such as the hex nut C1 and its upwardly projecting threaded bolt portion 50. In such case, the pins are free to extend downwardly into the recess 56 to assure driving contact with the sides of the nut C1 and to upwardly extend, that is, in relationship to other pin groups, to accommodate the upper surfaces of the nuts C1 and the projecting bolt 50.

Figure 7:
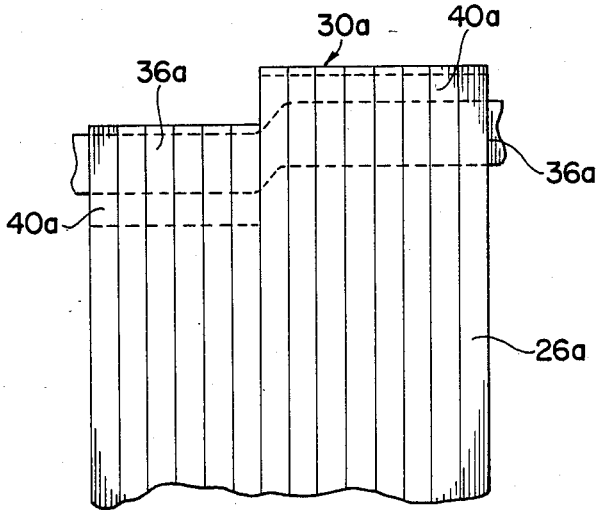
FIG. 7 is a sectional view on an enlarged scale showing the manner in which the pins may be vertically displaced when the suspension means is composed of a plurality of elastic rails.

Turning now to FIG. 7 of the drawings, a modified form 30*a* of the suspension means previously referred to in the other embodiments by the reference numeral 30 is shown. Therein, the rails 36*a* are formed from an elastic strip material such that when the pins 26*a* have reached the full travel extent permitted by the slots 40*a* then the elastic member 36*a* enables an upward further extension thereof. Such further extension stores elastic energy within the rail 36*a* such that, upon release of the pins from contacting the driveable component, the elastic member forces the pins back to their normal position.

Figure 8:
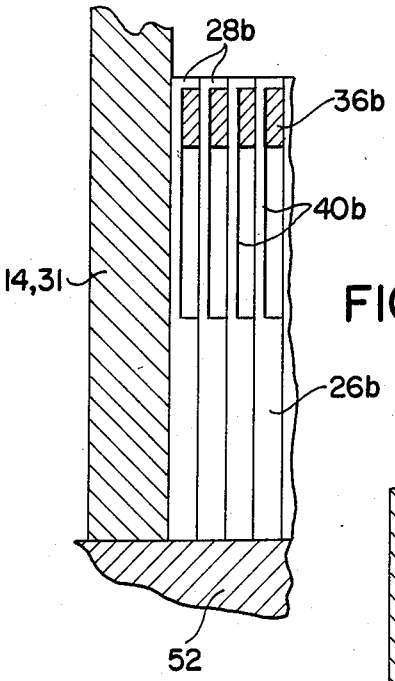
FIG. 8 is a partial side elevational view similar to FIG. 4 showing another manner in which the pins may be supported yet provide the desired vertical displacement.

Turning now to FIGS. 8, 9, 10 and 11, further alternate slot means are depicted for suspending the pins. Thus in FIG. 8 the upper ends of pins 26*b* are supplied with a slot 40*b* which unlike slot 40 is not of closed configuration on one side, that is, it is an open slot that opens on one side of the pin heads 28*b* and of a thickness less than the full pin head thickness. The slots 40*b* are shown in FIG. 8 as open on the left side with the rails 36*b* positioned therein. In this manner, the rails do not have to be in effect threaded through the slots as in the case of slots 40 but may be fitted upon the rails after positioning the rails within the pin casing (when utilized) or the housing walls 14. In effect, the open slot 40*b* is closed by the unslotted side of the adjacent pin head 28*b*.

Figure 9:
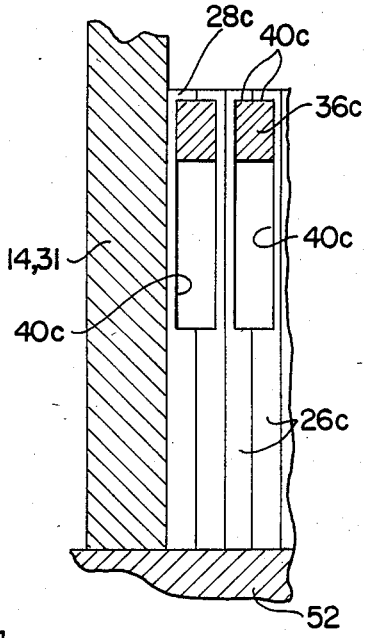
FIG. 9 is a partial side elevational view similar to FIG. 8 but showing still another pin support system.
Figure 13:
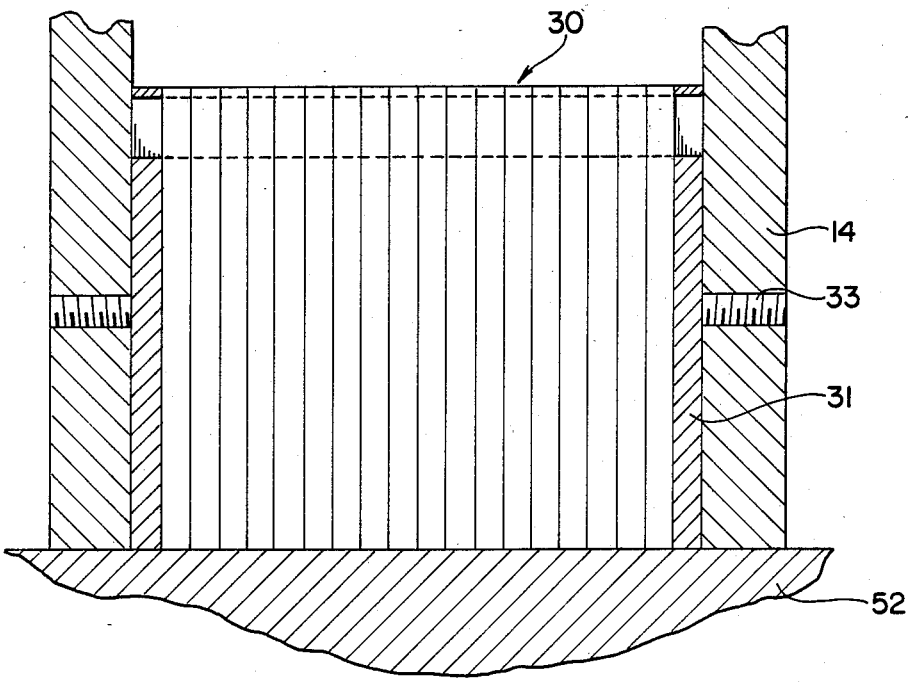
FIG. 13 is a side elevational view similar to FIG. 4 but showing the manner in which an inner pin casing may be attached to the outer socket casing or shell.

Similarly in FIG. 9, the adjacent faces of alternate pairs of pins 26*c* are formed with opposed open slots 40*c* which cooperatively form a composite slot for receipt of the rail 36*c*. In this case if the rail 36*c* is about ½ inch thick, then each slot 40*c* would be ¼ inch thick assuming a pin thickness of about one inch. For comparison, both the slots 40*b* and 40 would be ½ inch thick. Of course, such exact dimensioning is primarily for purposes of illustration and explanation, and any appropriate dimensions can be used.

Turning now to FIG. 10, a modified form of pin 26*d* is depicted in which the pin has an integral enlarged head 28*d* and a narrowed intermediate portion which, in effect, forms a circumferential slot 40*d* therearound and an enlarged lower portion 26*d*. The rails 36*d* are adapted to extend within the slots 40*d* in a similar fashion, and operation is as with the other embodiments. An advantage of the configuration of the pins 36*d* is that they are easier to machine and, accordingly, less expensive. Also shown in FIG. 10 is a spring system 60*d*—the operation of which will be hereinafter explained.

Figure 11:
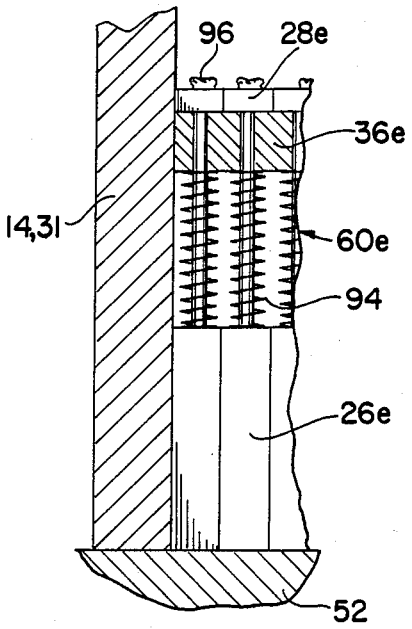
FIG. 11 is a partial side elevational view similar to FIGS. 8–10 but showing still another pin and pin support system.
Figure 12:
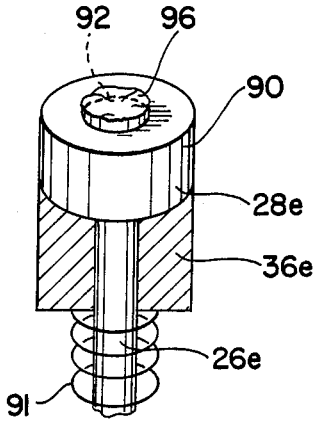
FIG. 12 is an enlarged partial perspective view of a portion of FIG. 11.

Turning now to FIGS. 11 and 12, a still further modified form of contact pins 26*e* is shown. Therein the pins are similar in shape to those shown in FIG. 10 with the exception that the enlarged upper end 28*e* thereof is not integral with the pin but formed by a collar or washer 90 having an opening or bore 92 therethrough. The narrowed portion of the pins 26*e* are positioned within the housing 14, 31 such that an individual spring 94 may be inserted therearound such that the upper end of the reduced diameter portion of the pin 26*e* will extend through the openings formed between adjacent rails 36*e*. In this manner, the springs 94 each engage the base portions of the rails 36 such that as the pins 26*e* are forced upwardly as by engagement of a member to be turned, then such action will compress a spring or springs 94 dependent on the lateral extent of the member such that when the twisting or turning action is completed, the springs will force the pins back to their original position. In order that the pin is retained at the upper end of the housing, that portion of the pin which protrudes through the collar 90 is peened over in an enlarged or headed section 96. It should be brought out that the collar 90 is free to spin, that is, move independently of the pin 26*e* and primarily serves as a means to space the headed portion 96 from the rails 36*e* and to prevent wear thereon.

In the embodiments shown in FIGS. 3 through 6 and 8 through 14, it should be pointed out that the pins are returned to their normal position either by gravity or by a spring system. One such spring system 60 is best illustrated by reference to FIG. 2 of the drawings. Therein, a flat wound coil spring 62 is mounted within the upper end of the chamber 22 in a flat position above and in operational contact with the upper ends 28 of the pins 26. Accordingly when groups of pins 26 are upwardly displaced in the intended manner, the pins contact the individual wound portions of the spring 62 to displace them upwardly out of the main flat plane thereof. When the pins are removed from the displacing component, the spring 62 acts to return them to their normal position. To prevent the above described intended distortion of the spring 62 from unwinding or otherwise damaging the spring 62, a plurality of telescoped coil springs 64 are provided therebehind. In some cases, it is intended that the coil spring 62 be replaced by an elastic planar member such as a sheet of rubber stretched across the upper portion of the chamber 22 and in operational contact with the upper ends of the pins 26. With such elastic member (not shown), the telescoping coil springs or other means to insure the return or unintended displacement of the elastic member could be utilized.

Figure 14:
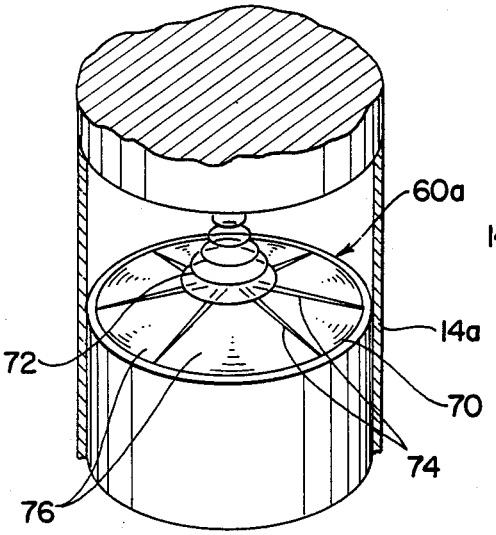
FIG. 14 is a partial perspective view similar to FIG. 2 showing another pin return means.

Another spring system 60*a* is illustrated in FIG. 14 of the drawings. Therein a disc 70 is disposed above and in contact with the upper pin ends 28. The disc may be peripherally and fixedly attached to the casing 14*a* in any suitable manner or simply may be held in position by a coil spring 72 centrally disposed thereabove and in turn contacting another portion of the casing 14*a* at its upper end. In any event, the disc 70 is segmented by cut lines 74 which form individual pie-shaped segments 76 generally attached to an uncut, that is, continuous, peripheral edge portion and which are capable of being upwardly (longitudinally) biased by the longitudinal movement of the pins 26. Such upward bias of the segment or segments 76 stores energy and results in the disc 70 acting as an alternate spring system 60*a*. Generally, the disc would be made of a spring type sheet material such as steel or somewhat rigid resinous plastic. It should also be brought out that the coil spring 72 when utilized functions as a spring in the above manner as well as a spacer.

A still further spring system 60*d* is illustrated in connection with FIG. 10 of the drawings. From an observation of such, it may clear that such spring system 60*d* is comprised of telescopic cups including an outer cup 80 and an inner cup 82. Some conventional means not shown are provided to prevent the cups from separating including the relative dimensioning of such within a limited space, and a spring 84 is provided intermediate the cups such that when the upper ends of the pins 28*d* contact the lower surface 86 of the outer cup 80, the outer cut is forced upwardly around the inner cup 82 against the spring 84 action such that when the contact member is removed, the energy stored in the spring 84 will force the outer cut 80 downwardly and, accordingly, reposition the pins 26*d*.

A still further spring system 60*e* is explained in connection with the discussion of FIGS. 11 and 12 above. It should be pointed out that a system such as 60*e* is of particular use in connection with a physically large system although not necessarily limited thereto, and that a plurality of systems 60*d* may be utilized in conjunction with a single housing 14, 31 if such increased control is desirable or necessary.

Generally in connection with the systems discussed, the pins that are not in contact with the member to be twisted are either held in place by side by side friction or by action of individual spring systems such as described in connection with spring system 60*e* or when more than one spring system 60*d* are utilized. In other words when working in an inverted position as may be necessary, such friction prevents the pins from moving longitudinally when not in contact with a member to be twisted.

Another important aspect of the present invention is the ability of the pins to extend beyond the lower extent 24 of the chamber 22 such that recessed members such as shown in FIGS. 5 and 6 may be more easily accommodated. In any case, the device 10 is placed in the drive position over or under the component in generally superposed position and then wiggled a little to settle the pins in or around the component which is to be form contacted. When the proper engagement has been achieved, the housing regardless of its shape is rotated with respect to the component to either loosen or tighten such. Accordingly, a device is provided which accomplishes the desire objectives of the invention in a positive manner yet enables many types of screw components to be dealt with such as screws including the Allen screw, standard screw, Phillips head screws, and of course, bolts whether projecting or recessed. If the screw is set below the contact surface, then the pins should protrude beyond their casing assuming that the hole around the screw is round or without interference when rotation of the casing takes place, i.e., the entire end of the casing could fit into the hole around the screw.

Figure 15:
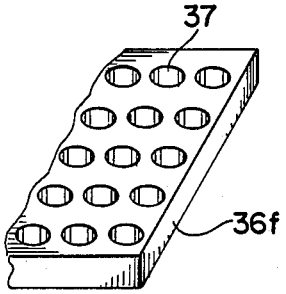
FIG. 15 is a partial perspective view of an alternate pin support means.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims. One such modification involves the above descriptive use of the term rails. In that specific regard, it should be pointed out that the rails are, in effect, pin support and guide means, and other structures could accomplish such function. One such structure would be a plate with a series of holes through which the pins extend at their reduced thickness portions (slots, recesses, reduced diameter, etc.) and abut at their thicker upper and lower ends. Such plate could be formed of metal or plastic and could be conventionally formed outside of the unit as by drilling, cutting, etc. or could be formed in situ as by pouring or casting the plate material (usually plastic in such cases) about the pins to, in effect, form a sheet or plate with holes or openings in which the pins may longitudinally move with respect thereto. With such in situ formation techniques, undercuts etc. may be provided in the housing to effect a connection of the plate, sheet, rails, etc. thereto. Thus the term rail, rails, etc. encompasses plates, sheets, etc. so long as the pin support function is accomplished. Such a plate, sheet, or substitute rail system **36*f* is depicted in FIG. 15 wherein openings 37 for pins 26** are shown as well.

What is claimed is:

1. A tool for turning components of varying sizes and shapes comprising a housing forming a chamber open at the lower end thereof, a bundle of a plurality of individual pins each having upper and lower ends longitudinally oriented in said chamber in a first normal position with their lower end surfaces adapted to contact the varying size and shape components, said housing having suspension means at the upper end thereof engaging the pin upper ends for suspending said pins in individual slidable relationship to each other where contact of the pin lower end surfaces with the component will force the contacted pins further upwardly into said chamber to a second position and means for returning said pins to their first normal position once contact with the component is removed, said means at the upper end of said housing for suspending said pins being a set of laterally oriented side by side rails positioned across the upper chamber end, said pin upper ends each having a closed end elongated slot through which said rails extend thereby both suspending said pins from said rails and permitting individual longitudinal pin travel as determined by the length of said slots.

2. The tool of claim 1 said rails being parallel strips of thin sheet material.

3. The tool of claim 2, said rails being of a non elastic material essentially non deformable along the longitudinal axis in which said pins are oriented.

4. The tool of claim 2, said rails being elastically deformable along the longitudinal axis in which said pins are oriented and at least in part forming the means by which the pins are returned to their first position.

5. The tool of claim 1, said slots being holes extending through said pin upper ends, said holes being closed on both sides.

6. The tool of claim 1, said slots being open on one side thereof.

7. The tool of claim 6, said open slot sides of adjacent pins facing each other so as to form a composite slot.

8. The tool of claim 6, said open slot sides of adjacent pins similarly aligned such that the open side of said slots is closed by the adjacent pin.

9. The tool of claim 1, said slots formed by a reduced thickness section of said pins.

10. The tool of claim 9, said means for returning said pins to their first normal position being individual springs mounted on said pins and positioned in said reduced thickness sections.

11. The tool of claim 1, said means for returning the pins including a flat spring laterally disposed across the chamber upper end in operational contact with said upper pin ends.

12. The tool of claim 11, said spring being a flat longitudinally elastic member.

13. The tool of claim 11, said spring being a flat wound coil spring disposed laterally across said chamber upper end with the pin upper ends adapted to operationally contact lower edges of said coils.

14. The tool of claim 13, there being a plurality of telescoping springs positioned above said flat wound coil spring to continually urge individual coils of said flat wound coil spring towards said flat position.

15. The tool of claim 11, said spring being a disc having a plurality of peripherally interconnected segments adapted to individually longitudinally move to accommodate said longitudinal pin travel.

16. The tool of claim 15 wherein said disc is centrally engaged by a coil spring to urge said segments toward this normal flat position.

17. A tool for turning components of varying sizes and shapes comprising a housing forming a chamber open at the lower end thereof, a bundle of a plurality of individual pins each having upper and lower ends longitudinally oriented in said chamber in a first normal position with their lower end surfaces adapted to contact the varying size and shape components, said housing having suspension means at the upper end thereof engaging the pin upper ends for suspending said pins in individual slidable relationship to each other where contact of the pin lower end surfaces with the component will force the contacted pins further upwardly into said chamber to a second position and means for returning said pins to their first normal position once contact with the component is removed, said means at the upper end of said housing for suspending said pins being a set of laterally oriented side by side rails positioned across the upper chamber end, said pin upper ends each having a closed end elongated slot through which said rails extend thereby both suspending said pins from said rails and permitting individual longitudinal pin travel as determined by the length of said slots and wherein said pin lower ends extend outwardly beyond the lower open end of said chamber.

18. The tool of claim 17, said rails being parallel strips of thin sheet material.

* * * * *